US006592107B1

(12) United States Patent
Wong

(10) Patent No.: US 6,592,107 B1
(45) Date of Patent: Jul. 15, 2003

(54) FLOATING PORTABLE HUMIDIFIER

(75) Inventor: Ying Man John Wong, Shatin (HK)

(73) Assignee: Raymond Electric (China) Ltd., Hong Kong (CN)

( * ) Notice: Subject to any disclaimer, the term of this patent is extended or adjusted under 35 U.S.C. 154(b) by 0 days.

(21) Appl. No.: 09/899,676

(22) Filed: Jul. 5, 2001

(51) Int. Cl.[7] ..... B01F 3/04

(52) U.S. Cl. ..... 261/142; 261/84; 261/107; 261/120; 392/404; 392/406

(58) Field of Search ..... 261/120, 127, 261/30, 81, 99, 107, 142, 721, DIG. 29, DIG. 30, DIG. 65; 392/403, 404, 405, 406

(56) References Cited

U.S. PATENT DOCUMENTS 1,836,868 A * 12/1931 Page
2,840,682 A * 6/1958 Rubenstein et al.
2,875,314 A * 5/1959 Schreyer
3,301,998 A * 1/1967 Trickey
3,584,192 A * 6/1971 Maag ..... 261/142
3,864,437 A * 2/1975 Blaszkowski
4,217,315 A * 8/1980 Keeler, II ..... 261/120
4,699,737 A * 10/1987 Engstrand ..... 261/120
4,734,561 A * 3/1988 Miller
5,673,360 A * 9/1997 Scripps ..... 392/405
5,940,578 A * 8/1999 Goddard ..... 392/406

* cited by examiner

*Primary Examiner*—C. Scott Bushey
(74) *Attorney, Agent, or Firm*—Alix, Yale & Ristas, LLP

(57) ABSTRACT

A floating portable humidifier is configured to float partially submerged in an open tray of water. An internal cavity includes water entry apertures below the water line and air entry apertures above the water line. Water enters the cavity through the water entry apertures to establish a constant water level within the cavity. Humidifying apparatus installed within the cavity combines water and air to form humidified air that leaves the humidifier through air exit apertures. A motor-driven fan may assist circulation of humidified air. Sealed chambers or a porous closed cell body construction may provide the necessary buoyancy. Any humidifying apparatus may be used. The floating design eliminates the need for a water tank.

6 Claims, 3 Drawing Sheets

FLOATING PORTABLE HUMIDIFIER

BACKGROUND OF THE INVENTION

1. Field of the Invention

This invention relates to appliances known as humidifiers and more particularly to a floating portable humidifier.

2. Description of the Related Art

Generally, a humidifier is a device for dispersing water vapor into the air for the purpose of raising the humidity in a given space. A wide variety of humidifiers are available for both commercial and residential use. Most humidifiers incorporate one of several known humidifying technologies, including evaporation, ultrasonic, heating, wicking, electrolysis or fine-mist dispersion. All of these technologies require a reliable source of water, which is typically provided by means of a water tank. Some larger scale home and industrial humidifiers are connected to the water supply of the facility, but this type of connection may be impractical for home use.

The water tank presents several potential drawbacks. First, the water tank is typically the largest component of the humidifier. The large size of the water tank tends to make the humidifier too large and bulky to be considered truly portable. Second, standing water in the water tank may become contaminated with algae, bacteria, or fungi. These growths present a potential health hazard and present the prospect of a foul smell from the humidifier. The water tanks are generally closed and may be difficult to fully clean and disinfect. Further, the procedures required for filling the water tank and/or cleaning the water tank are frequently awkward and complex. Filling the water tank may require lifting of the filled tank, which may be difficult for the elderly or infirm. Additionally, the manufacture of the sealed water tank and the tank/humidifier interface tend to be expensive, increasing the overall cost of the humidifier.

Individuals with respiratory ailments, skin disorders and other medical conditions may require moist air to treat or alleviate their condition. Others may simply find it desirable to have an elevated moisture content in the air they breathe. When traveling, such individuals have had difficulty transporting the necessary humidifying equipment because of the size and generally bulky configuration of prior art humidifiers. In sum, there is a need in the art for a compact, lightweight, fully portable humidifier that, for example, may be packed conveniently in carry-on size luggage.

SUMMARY OF THE INVENTION

One preferred embodiment of the floating portable humidifier comprises a compact floating body surrounding a cavity that contains humidifying components. The floating body includes openings permitting the entry of air and water and the exit of humidified air. The body is configured to float partially submerged in water. Since the weight and size of the humidifying components are known, the configuration of the floating body can be selected such that a known portion of the body is submerged (assuming the water is of sufficient depth).

Water enters the floating body through apertures below the waterline while air enters the floating body via apertures above the waterline. Regardless of the level of water in the tray, the floating portable humidifier will remain suspended in the water and retain a particular level of water inside the body (again, assuming sufficient depth). Water inside the floating body is accessible to humidifying apparati which may include, but are not limited to, a wick or other such evaporative element, a heating chamber to generate steam or an ultrasonic device to generate cool mist as is generally known in the art. The floating portable humidifier may also be provided with a motor-driven fan to assist in circulating the humidified air.

Buoyancy may be provided by constructing the floating body of a buoyant material, i.e., lightweight plastic, foam, closed-cell or hollow synthetic materials. Alternatively, buoyancy may be provided by sealed gas-filled chambers molded into or affixed to the inside or outside of the floating body. It is important that the floating body have a stable configuration, i.e., when placed in water will float upright with the water apertures below the waterline. The humidifying and air circulating components are preferably arranged within the cavity in such way as to improve the stability of the floating portable humidifier.

The floating portable humidifier can have a compact and relatively lightweight configuration because it does not include a water tank. The floating portable humidifier may be packed and taken on a trip, for example and, upon reaching a destination, the humidifier may be set up in a sink, an ice bucket or any convenient water-holding receptacle. The portable humidifier is preferably provided with a power cord for supplying power to components such as a fan, ultrasonic humidifying apparatus or heating elements as necessary. For some configurations of the portable humidifier, battery power may be sufficient. Preferably, a transformer is provided to supply the floating portable humidifier with low voltage direct current. The floating portable humidifier may be expediently provided with safety devices such as fuses, circuit breakers, switches or sensors to ensure that if powered portions of the unit become submerged, power is removed. More expediently, the power cord may be provided with a ground-fault sensor as is known in the art.

An object of the present invention is to provide a new and improved floating portable humidifier of compact and efficient design.

Another object of the present invention is to provide a new and improved floating portable humidifier that eliminates the water tank component typically incorporated into prior art humidifiers.

A further object of the present invention is to provide a new and improved floating portable humidifier that may be used in any convenient body of water.

DETAILED DESCRIPTION OF THE PREFERRED EMBODIMENTS

Figure 2:
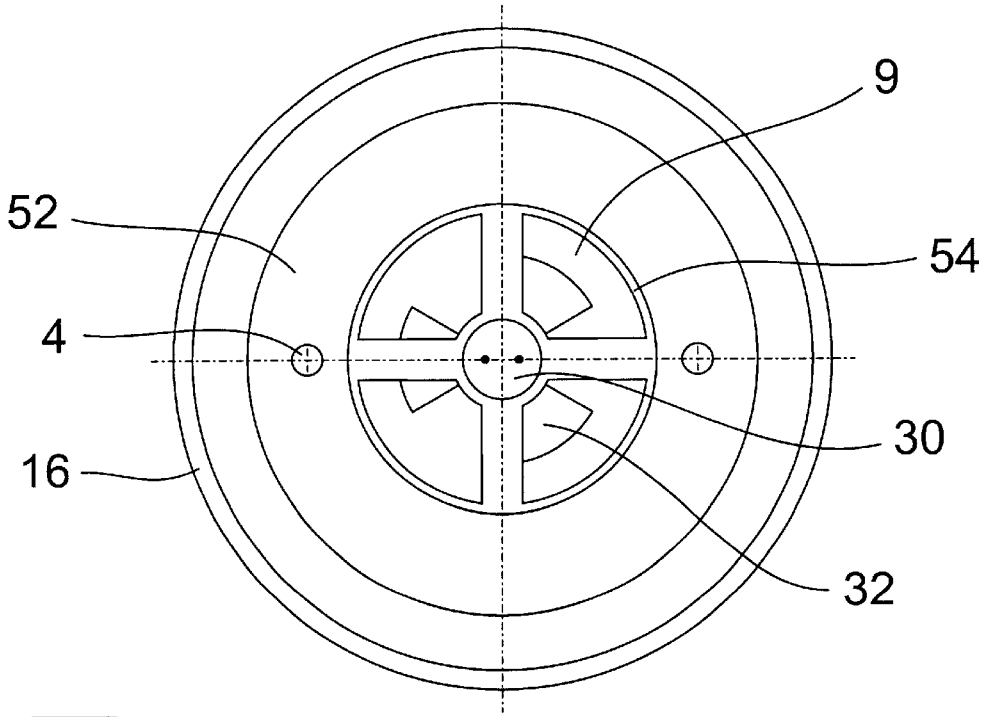
FIG. 2 is a top plan view of the floating portable humidifier of FIG. 1.

With reference to the drawings, wherein like numerals represent like features throughout the several figures, a first preferred embodiment of a floating portable humidifier in accordance with the present invention is designated by the numeral 10. Second and third preferred embodiments are identified by reference numerals 12 and 14, respectively. The illustrated preferred embodiments of the floating portable humidifier are intended for use as highly portable, compact, personal humidifiers at home or when traveling. The floating portable humidifier is designed to use in any convenient body of water.

Figure 1:
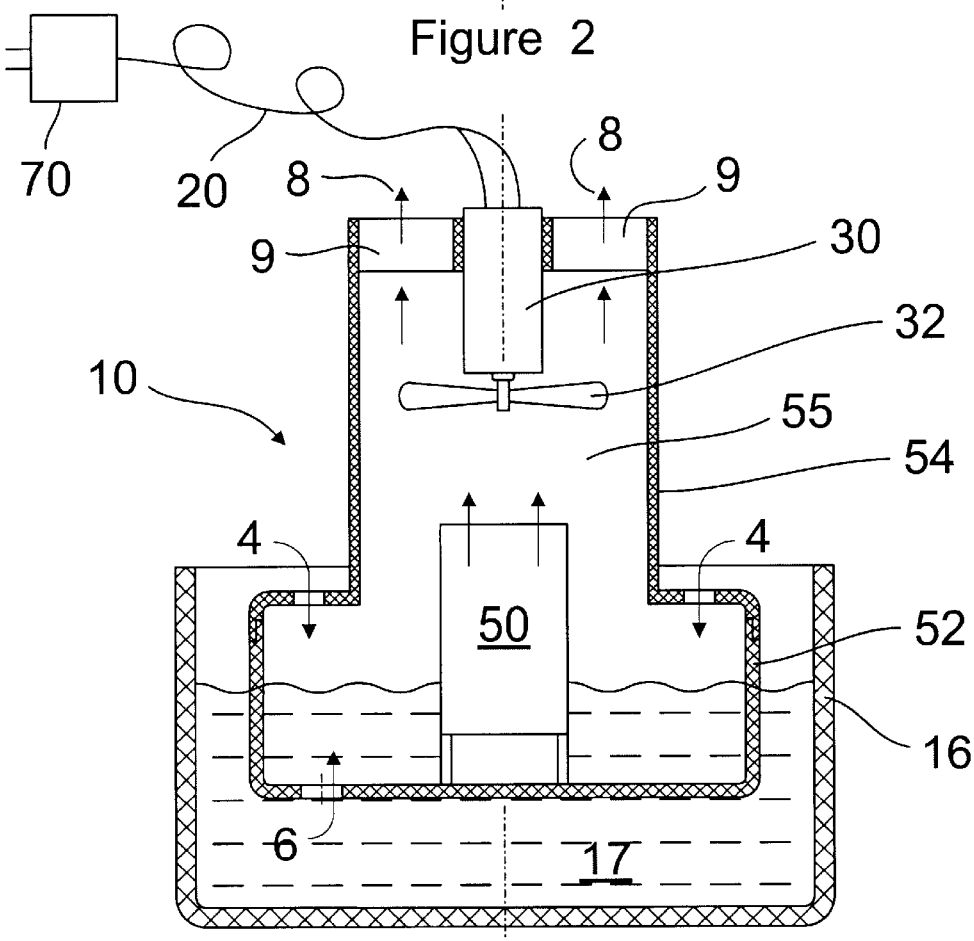
FIG. 1 is a sectional view through a first embodiment of a floating portable humidifier in accordance with the present invention in functional conjunction with a tray of water.

FIGS. 1 and 2 illustrate a first preferred embodiment 10 of the floating portable humidifier in an open tray 16 of water 17. FIG. 1 is a sectional view through the first embodiment 10 and tray 16 of water. This first preferred embodiment 10 uses an ultrasonic humidifying apparatus 50. The construction and operation of ultrasonic humidifying apparatus are generally known in the art and will not be described here. The floating portable humidifier 10 includes a body having a lower portion 52 and an upper portion 54. It can be seen from FIG. 1 that the lower portion 52 is configured as a broad, shallow, circular tray. The upper portion 54 is cylindrical and secures to an upper lip of the lower portion 52 to define an interior cavity 55. The lower portion 52 is manufactured from a closed-cell, rigid plastic foam having a buoyancy calculated such that when the assembled floating portable humidifier 10 is placed in an open tray of water 17, water enters through aperture 6 to a predetermined level.

The floating body 52, 54 is configured such that the predetermined level of water inside the body lower portion 52 renders the water accessible to the ultrasonic humidifying apparatus 50 while leaving sufficient dry space for the operation of a circulating fan 32 driven by a motor 30. The ultrasonic humidifying apparatus 50 draws water 17 from within the body lower portion 52, converting the water into mist which is emitted into the interior cavity 55. Fan 32 draws air upwards and out of the cavity 55 through apertures 9. Replacement air is admitted into the chamber 55 via air inlet apertures 4. Power is provided to the apparatus via power cord 20. Power cord 20 is preferably connected to a transformer 70 that converts household alternating current electricity into low voltage direct current. Low voltage direct current has much less risk for electric hazard.

To further improve the safety of the floating portable humidifier, it may be expedient to provide safety devices that prevent water from contacting sensitive electronic and electrical components such as the motor 30. Additionally, safety devices comprising sensors or switches that detect the presence of water or the position of the portable humidifier, insulation and grounding of the floating portable humidifier, including a ground-fault circuit interrupter, may also be provided.

It should be understood that the floating portable humidifier is balanced and shaped such that it will always maintain an upright position when placed in water. Further, while a stepped cylindrical shape floating body 52, 54 is illustrated, other shapes may easily be used without departing from the scope of the invention. As long as there is water in the tray 16 sufficient to permit the portable humidifier 10 to float, the water level within the cavity 55 will always remain the same.

The compact and efficient design eliminates the water tank and allows a truly compact and portable humidifier. The floating portable humidifier is simple to manufacture because there is no need for a sealed water tank nor need to provide complex interface between the humidifying apparatus 50 and the water tank. Operation of the portable humidifier 10 is simplified because an open tray is used. The open tray is easy to fill and clean. Suitable trays are generally available wherever the portable humidifier might be used.

Figure 4:
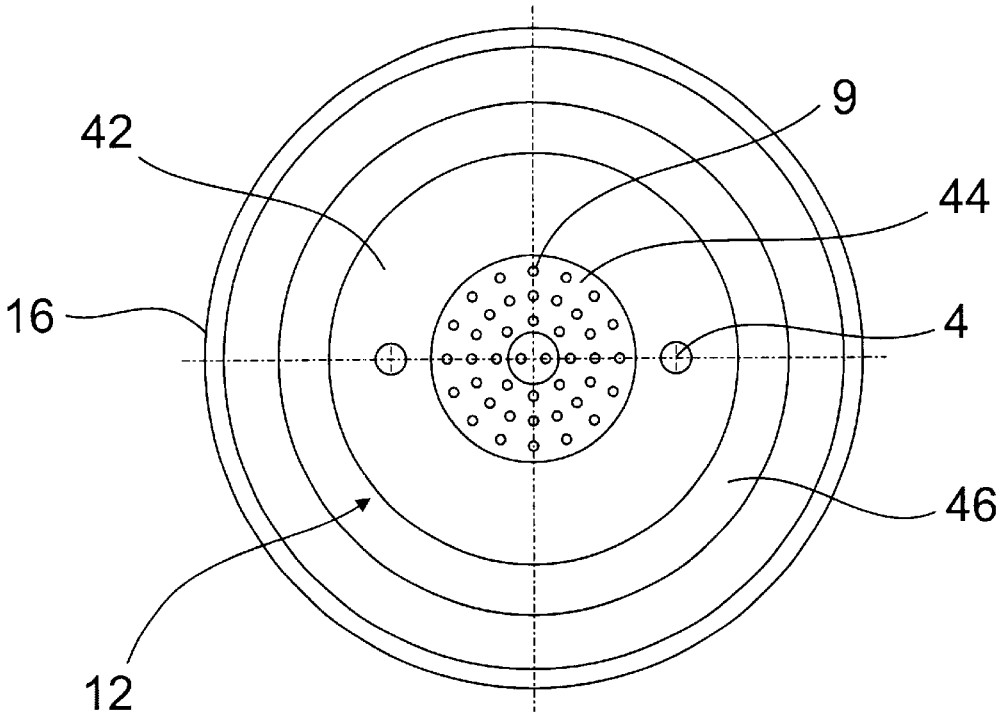
FIG. 4 is a top plan view of the floating portable humidifier of FIG. 3.
Figure 3:
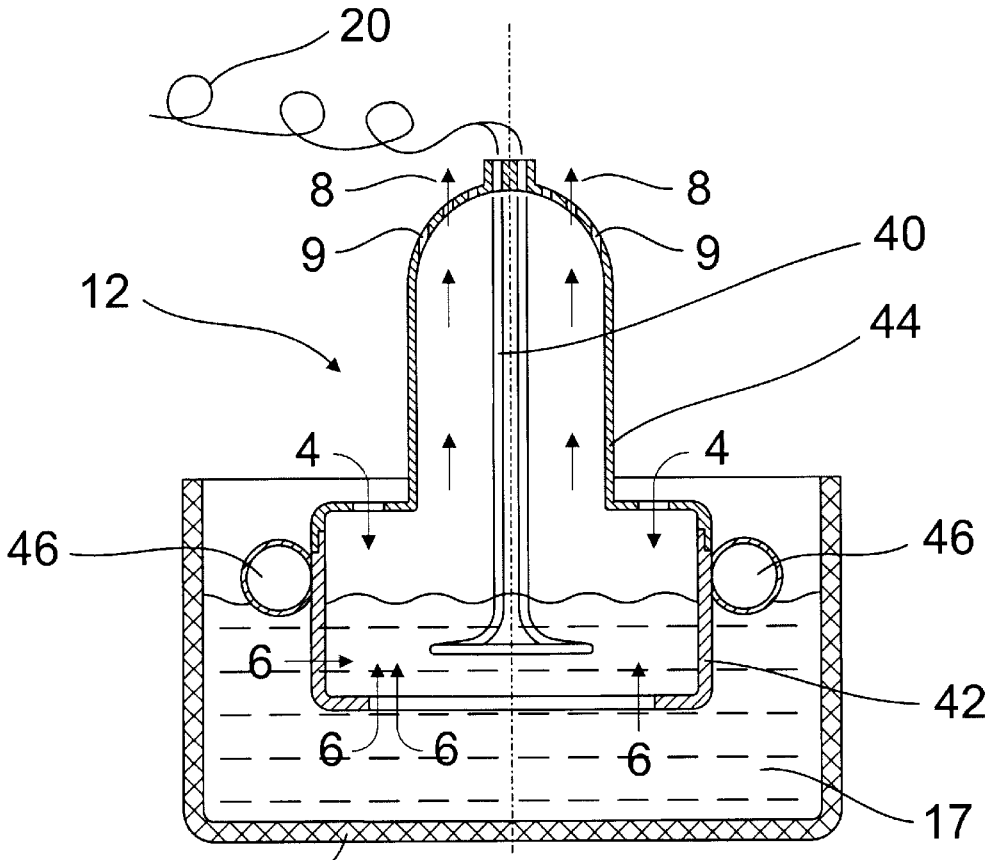
FIG. 3 is a sectional view through a second embodiment of a floating portable humidifier in accordance with the present invention in functional conjunction with a tray of water.

FIGS. 3 and 4 illustrate a second preferred embodiment 12 of the floating portable humidifier in accordance with the present invention, again illustrated in a tray 16 of water 17. This second preferred embodiment 12 is configured around a heating element 40 intended to humidify via warm steam convection as is known in the art. Heating element 40 boils water immediately around the element creating steam which, along with heated air, which enters the body cavity through a pair of diametrically opposed openings 4 and rises through the body upper portion 44 to exit the floating portable humidifier 12 as warm moist air 8 via apertures 9 formed by a plurality of openings arranged in a plurality of concentric rings.

The second preferred embodiment 12 provides buoyancy via a sealed chamber 46 rather than constructing the body lower portion 42 from a porous or buoyant material such as the body lower portion 52 of the first preferred embodiment 10. It should be understood that the configuration and positioning of the water entry apertures 6 can vary widely within the scope of the present invention. As long as the water entry apertures 6 are below the predetermined water line, the function of providing water to the interior of the floating portable humidifier will be served. FIG. 3 illustrates water entry apertures 6 located on the side wall of the lower portion 42 and also as a slot traversing the bottom of the lower portion 42.

Figure 5:
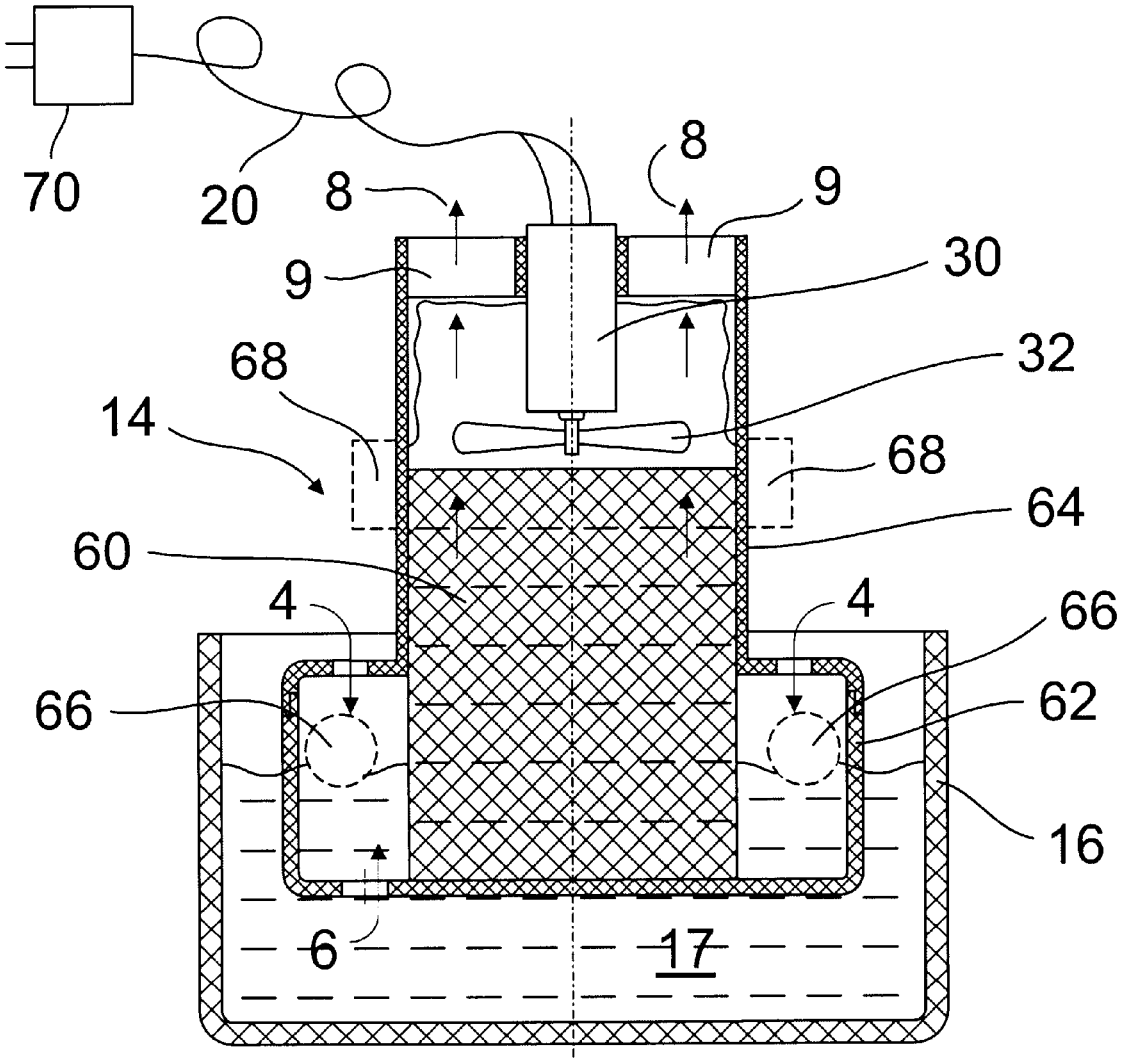
FIG. 5 is a sectional view through a third preferred embodiment of a floating portable humidifier in accordance with the present invention.

FIG. 5 illustrates a third preferred embodiment 14 of the floating portable humidifier. In many respects, the third embodiment resembles the first embodiment 10 in that it incorporates a fan 32 driven by a motor 30, a buoyant body lower portion 62 and upper portion 64. This third embodiment illustrates the use of a wicking or evaporative humidifying technique as is common in the art. The wick 60 absorbs water and draws the water up above the water line. Air circulating over the wet wick 60 is humidified by moisture evaporating from the wick. Humidified air 8 exits through apertures 9. The third preferred embodiment 14 illustrates an alternative position for sealed chambers 66 within the body lower portion 62.

When power is applied to the fan motor 30 via power cord 20 air is drawn into the cavity 55 through apertures 4 and over the wick 60. One advantage of wick-type evaporative humidifying is its efficient use of energy. In fact, this technique may be so efficient that power may be provided via batteries 68 attached to the floating portable humidifier 14.

The three illustrated embodiments of the floating portable humidifier illustrate that any of the commonly used humidifying techniques may be incorporated into the invention. While three common techniques are illustrated, the invention is applicable to any compact humidifying apparatus.

While several preferred embodiments of a buoyant body are illustrated, any practical and durable means for providing buoyancy are appropriate. The material itself may be of a specific gravity that it floats readily on water, as do many plastics. Constructing the body parts of low specific gravity plastic material will provide the necessary buoyancy without trapped gas or gas pockets.

While preferred embodiments of the foregoing invention have been set forth for purposes of illustration, the foregoing description should not be deemed a limitation of the invention herein. Accordingly, various modification, adaptations and alternatives may occur to one skilled in the art without departing from the spirit and the scope of the present invention.

What is claimed is:

1. A portable humidifier that floats on water, said portable humidifier comprising:

a buoyant body having a predetermined buoyancy in water and defining a cavity and including at least one water entry aperture and a plurality of air apertures, at least one of said air apertures comprising an air entry and at least one of said air apertures comprising an air exit, said air entry comprising a pair of diametrically opposed openings and said air exit comprising a plurality of openings arranged in a plurality of concentric rings;

a humidifying apparatus disposed within said cavity for humidifying air in said cavity; and power supply means for supplying power to said humidifying apparatus, wherein said portable humidifier has a weight and the predetermined buoyancy of said buoyant body is calculated so that a first portion of said buoyant body is submerged and a second portion of said buoyant body is above the water, said water entry aperture provided on said first portion and water entering said water entry aperture is accessible to said humidifying apparatus, said humidifying apparatus combining said water and air entering said cavity through said air entry to form humidified air which then exits said cavity through said air exit, said air entry positioned closer to the first portion of the buoyant body than the air exit.

2. The portable humidifier of claim 1, wherein said predetermined buoyancy is provided by a sealed pocket of gas attached to said buoyant body.

3. The portable humidifier of claim 1, wherein said predetermined buoyancy is provided by constructing at least some of said buoyant body from a material having a specific gravity less than water.

4. The portable humidifier of claim 1, wherein said humidifying apparatus is selected from the group consisting of an evaporative humidifying apparatus, an ultrasonic humidifying apparatus, and a heating element based humidifying apparatus.

5. The portable humidifier of claim 1, wherein said power supply means comprises a power cord operatively connected to said humidifying apparatus.

6. The portable humidifier of claim 5, wherein said power cord is operatively connected to a transformer that supplies said power supply means with low voltage direct current electricity.

* * * * *